US005762285A

United States Patent [19]

Lin

[11] Patent Number: 5,762,285

[45] Date of Patent: Jun. 9, 1998

[54] RACK FOR ROLLING TYPE SANITARY PAPER

[76] Inventor: Chen-Yu Lin, No. 235, Yu Chiun Road, Wu Feng Hsiang, Taichung Hsien, Taiwan

[21] Appl. No.: 879,822

[22] Filed: Jun. 20, 1997

[51] Int. Cl.[6] ..... B65H 16/00

[52] U.S. Cl. ..... 242/565; 242/597.5; 242/597.8

[58] Field of Search ..... 242/565, 597, 242/597.5, 597.8, 422.5, 599, 599.4

[56] References Cited

U.S. PATENT DOCUMENTS

| | | | |
|---|---|---|---|
| 1,391,326 | 9/1921 | Killian | 242/599 |
| 3,408,125 | 10/1968 | Rasmussen | 242/565 |
| 3,531,057 | 9/1970 | Way | 242/597.5 |
| 3,770,221 | 11/1973 | Stern | 242/599.4 |
| 3,871,593 | 3/1975 | Brinton | 242/565 |
| 3,918,661 | 11/1975 | Kishi et al. | 242/422.5 |
| 4,071,200 | 1/1978 | Stone | 242/599.4 |
| 5,215,274 | 6/1993 | Lin | 242/599 |
| 5,467,935 | 11/1995 | Moody | 242/565 |
| 5,484,119 | 1/1996 | Olive | 242/565 |

FOREIGN PATENT DOCUMENTS

| | | | |
|---|---|---|---|
| 1024404 | 3/1966 | United Kingdom | 242/422.5 |
| 2 241 938 | 9/1991 | United Kingdom | 242/565 |

*Primary Examiner*—John P. Darling

*Attorney, Agent, or Firm*—Morton J. Rosenberg; David I. Klein; Jun Y. Lee

[57] ABSTRACT

A rack for rolling type sanitary paper, including a fixing seat, a shaft disposed at front end of the fixing seat, a core member fitted around the shaft and a torque spring disposed between the shaft and the core member. The core member is passed through the reel of the sanitary paper and disposed with a stopper plate, whereby the user can tear apart the sanitary paper by constant amount. Each time after torn apart, the pulling end of the sanitary paper is restored to have a fixed length for ready use.

2 Claims, 6 Drawing Sheets

RACK FOR ROLLING TYPE SANITARY PAPER

BACKGROUND OF THE INVENTION

The present invention relates to a rack for rolling type sanitary paper (or toilet paper), in which the sanitary paper can be torn away by constant amount and after torn away, the sanitary paper is automatically restored to a ready state for next use so as to avoid waste.

FIG. 1 shows a conventional rack 10 for rolling type sanitary paper, including a fixing seat 11 fixedly installed on a wall, a cantilever 12 extending from one side of the fixing seat 11, a shaft 13 transversely disposed at the free ends of the cantilevers 12 and a protective cover 14 pivotally disposed on the top edge of the fixing seat 11.

The shaft 13 is passed through a reel of sanitary paper 20. A user can pull the sanitary paper 20 to rotate the reel thereof. After a certain length of sanitary paper is pulled out, the protective cover 1t is pressed against the reel for tearing apart the sanitary paper 20.

In use, the user often exerts excessively great force onto the sanitary paper so that the reel is often over-rotated. As a result, an excessively long sanitary paper will be unwound from the reel to cause waste. Also, an excessively long sanitary paper will suspend from the reel and is subject to contamination by dirty water. Such situation leads to waste of the sanitary paper and presents a poor appearance.

SUMMARY OF THE INVENTION

In order to obviate the above problems, it is a primary object of the present invention to provide a rack for rolling type sanitary paper, in which a user can tear apart the sanitary paper by constant amount and each time after the sanitary paper is torn apart, the pulling end thereof is restored to have a fixed length for ready use so as to avoid waste. According to the above object, the rack for rolling type sanitary paper includes a core member is fitted around the shaft of the rack. An inner end face of the core member is disposed with a stopper plate. A torque spring is disposed around the shaft. One end of the spring is fixed on the cantilever or the rack, while the other end thereof interrupts the moving path of the stopper plate when the core member is rotated. The fixed end of the shaft is disposed with a radially extending stopper section, whereby when the core member is rotated, the stopper section abuts against the stopper plate of the core member.

The present invention can be best understood through the following description and accompanying drawings, wherein:

DETAILED DESCRIPTION OF THE PREFERRED EMBODIMENT

Figure 1:
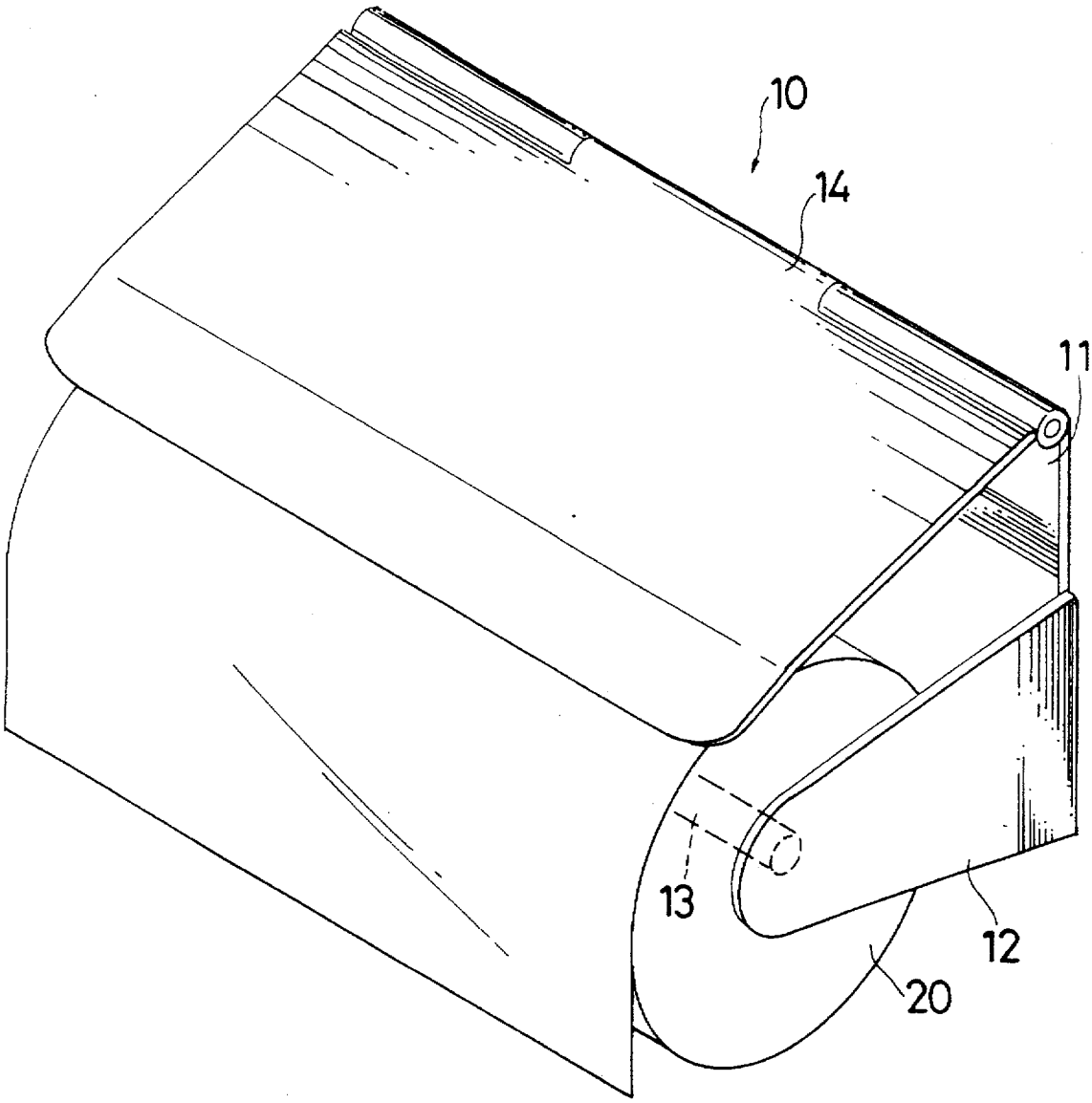
PRIOR ART FIG. 1
FIG. 1 is a perspective view of a conventional rack for rolling type sanitary paper.
Figure 2:
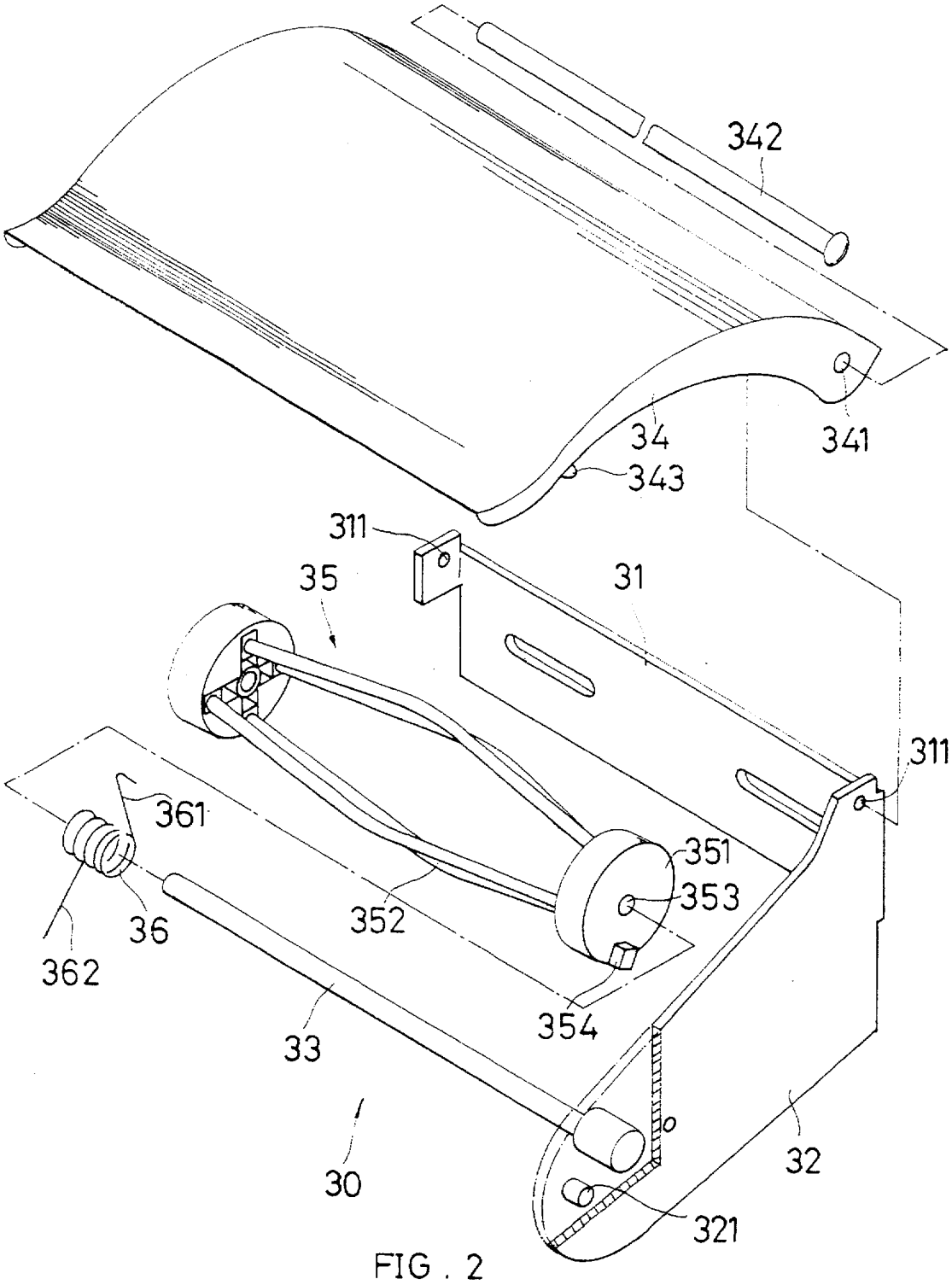
FIG. 2 is a perspective exploded view of the rack of the present invention.
Figure 3:
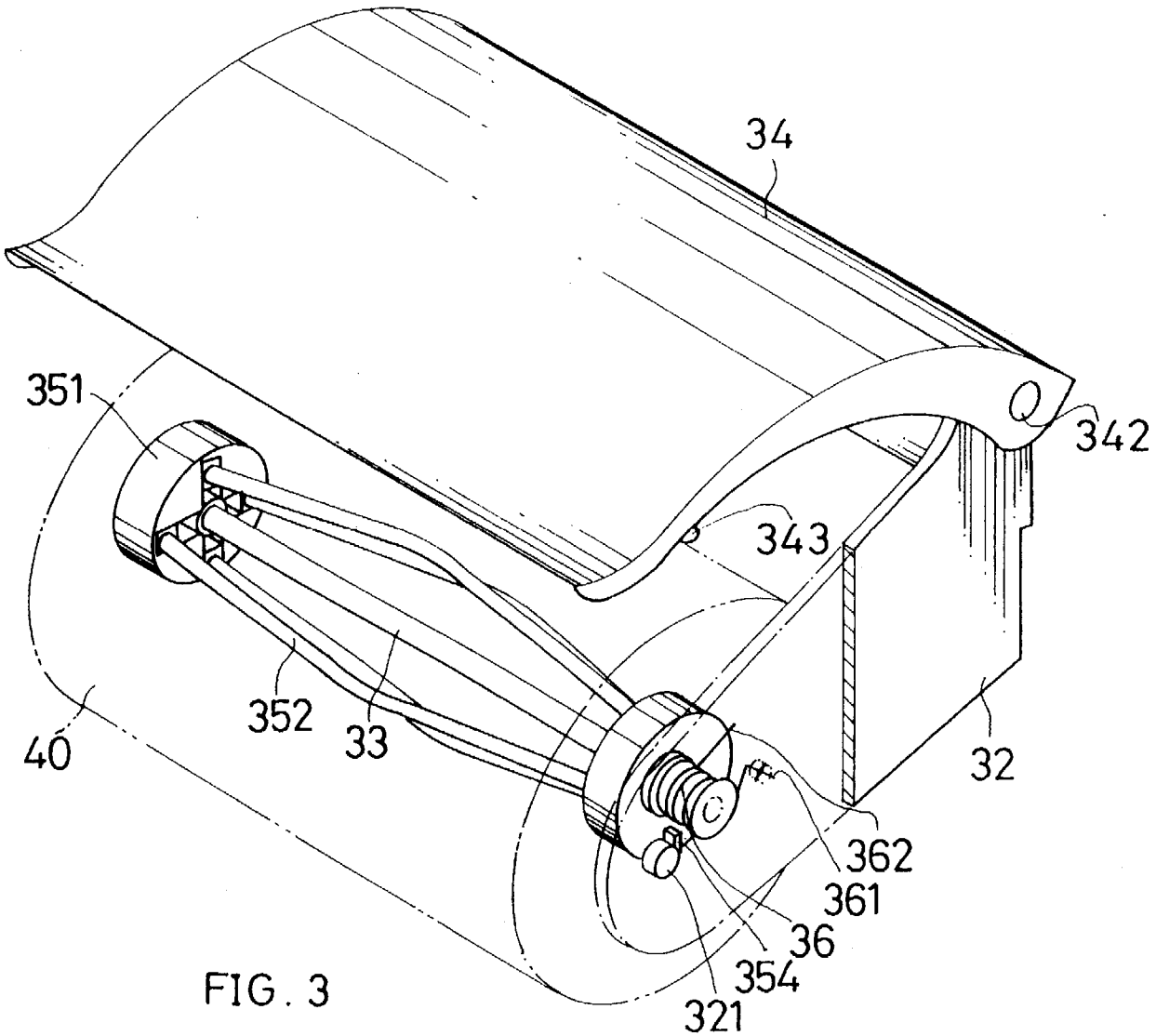
FIG. 3 is a perspective assembled view of the rack of the present invention.

Please refer to FIGS. 2 and 3. The rack 30 of the present invention includes:

- a flat rectangular fixing seat 31 formed with through holes 3l at upper ends of two sides;
- a cantilever 32 disposed on one side of the fixing seat 31 and having a stopper section 321 at free end;
- a shaft 33 one end of which is fixed behind the stopper section 321 of the cantilever 32 parallel to the fixing seat 31;
- a protective cover 34 formed with two through holes 341 on two sides, whereby a pin member is passed through the through holes 311 of the fixing seat 31 and the through holes 341 to pivotally 7 connect the protective cover 34 with the fixing seat 31, the protective cover 34 and the fixing seat 31 normally containing an angle, an inner ace of the protective cover 34 being formed with ribs 343;
- a core member 35 having two rotary discs 351 and several steel strips 352 extending between the inner faces of the rotary discs 351, each rotary disc 351 being formed with a central shaft hole 353 for the shaft to pass therethrough, one rotary disc abutting against an inner face of the cantilever 32, an end face of the rotary disc 351 near the fixed end of the shaft 33 being disposed with a projecting stopper plate 354, whereby when the core member 35 is rotated, the stopper plate 354 serves to touch the stopper section 321 of the cantilever 32; and
- a torque spring 36 fitted around the shaft 33 between the cantilever 32 and the opposite rotary disc 351, a fixing end 361 of the spring 36 being fixed on the cantilever 32, while a free end 362 thereof being positioned on the path of the stopper plate 354 of the core 35.

Normally, the stopper plate 354 is positioned between the stopper section 321 and the free end 362 of the spring 36.

Figure 4:
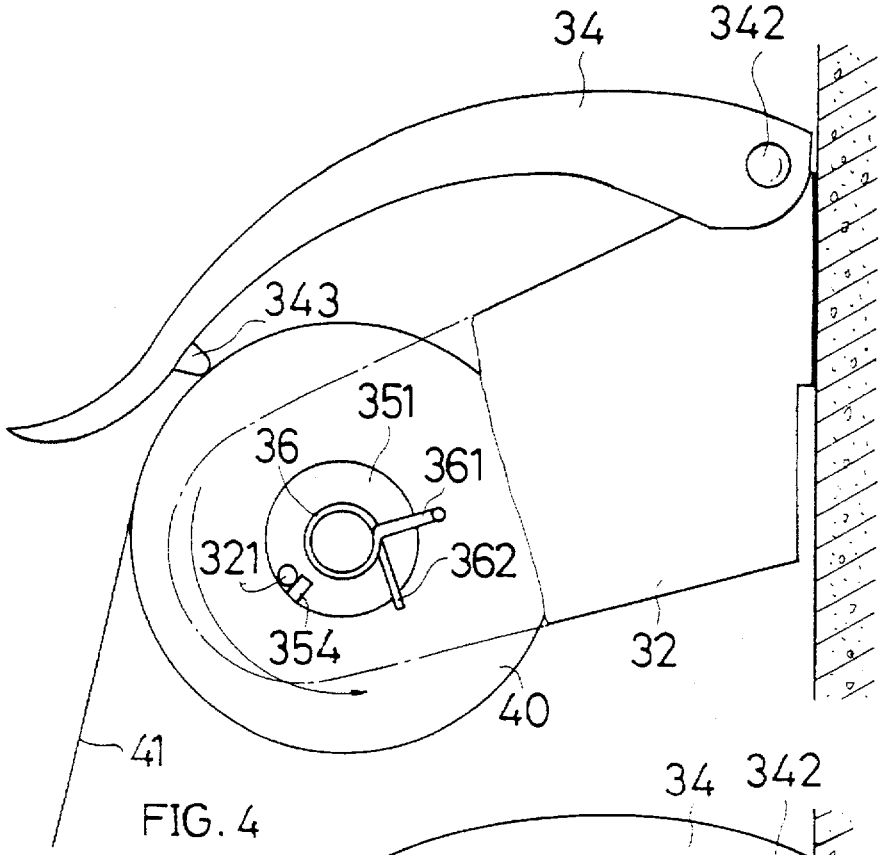
FIG. 4 shows the operation of the rack of the present invention in a first state.
Figure 5:
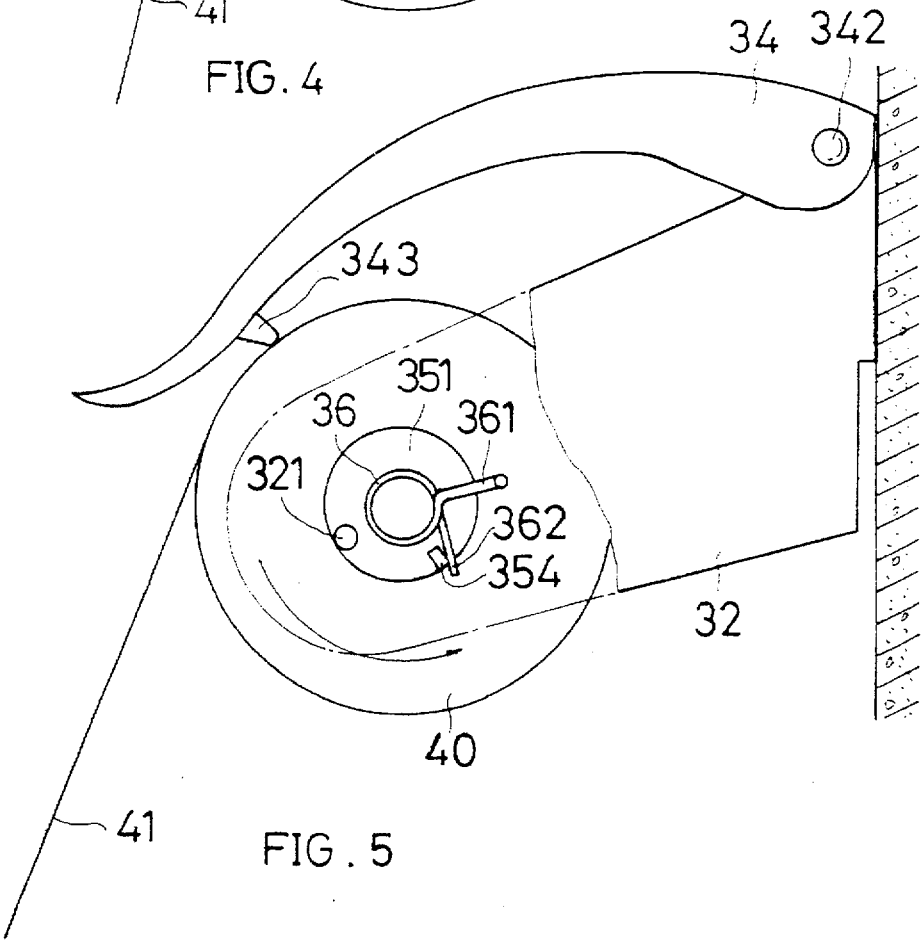
FIG. 5 shows the operation of the rack of the present invention in a second state.
Figure 6:
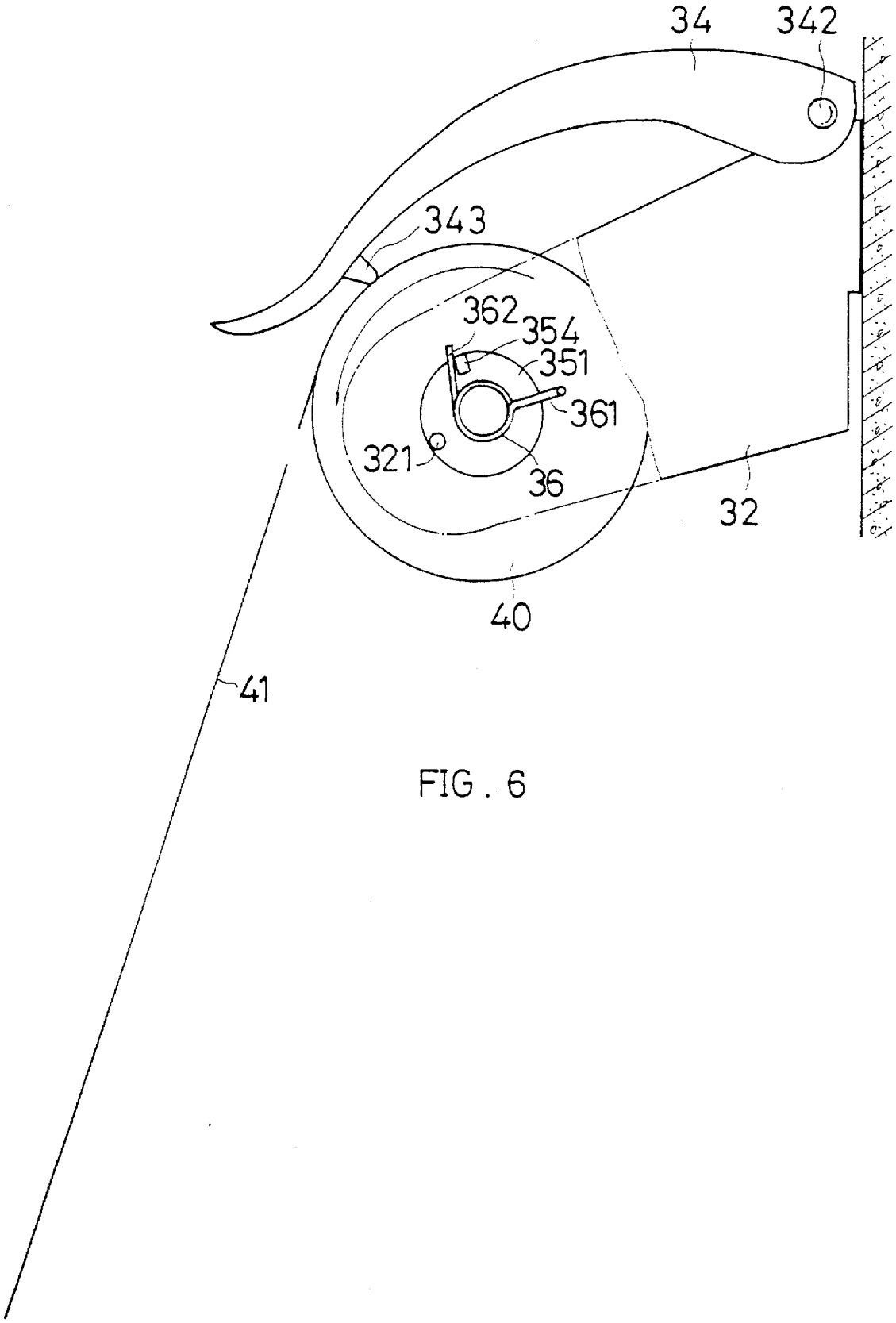
FIG. 6 shows the operation of the rack of the present invention in a third state.
Figure 7:
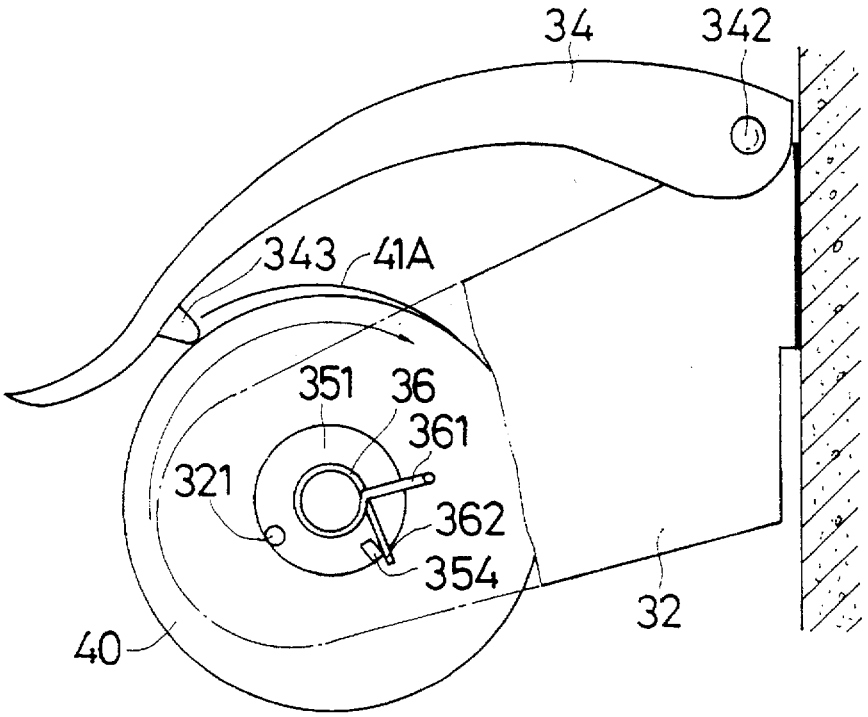
FIG. 7 shows the operation of the rack of the present invention in a fourth state.
Figure 8:
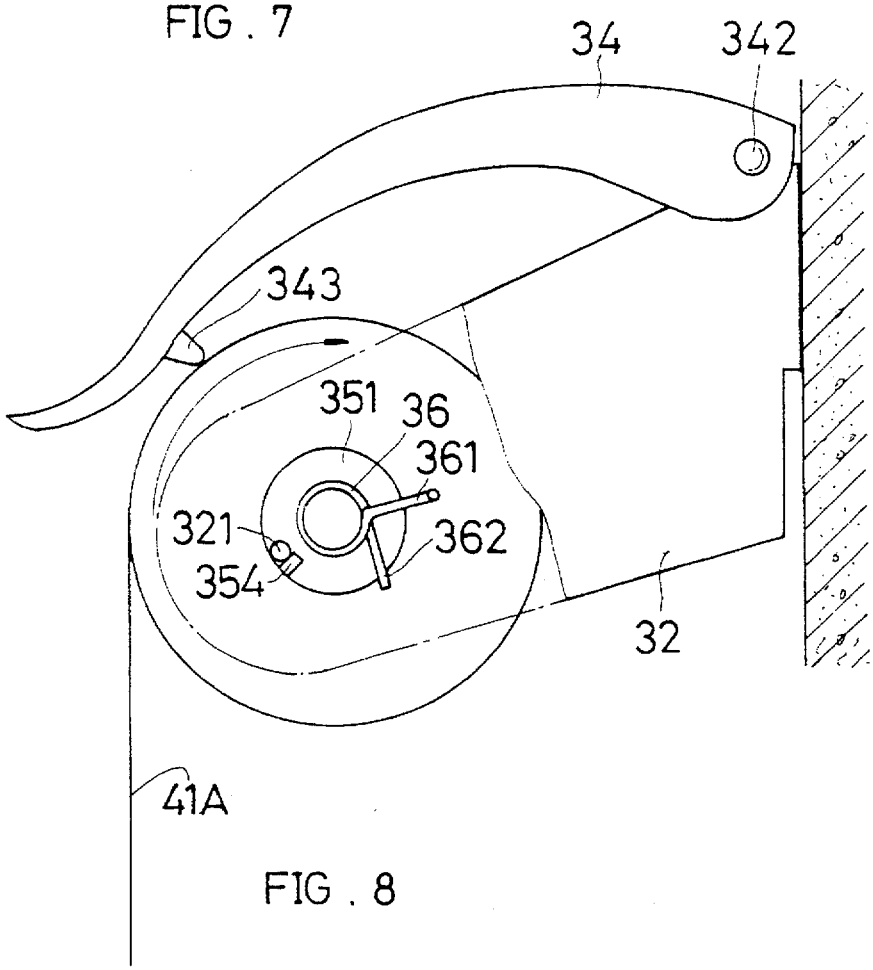
FIG. 8 shows the operation of the rack of the present invention in a fifth state.

Referring to FIGS. 4 to 8, according to the above arrangement, the core 35 is passed through the reel of the sanitary paper 40 with the steel strips 352 of the core 35 stretching the inner wall of the reel. A pulling end 41 of the sanitary paper 40 suspends from the reel. When tearing apart the paper, a user can pull the pulling end 41 of the sanitary paper 40 with one hand to rotate the core 35 about the shaft 33 as shown in FIG. 4. At this time, the core 35 (and the sanitary paper) suffers no resistance. Then, the stopper plate 354 of the core 35 will abut against the free end 362 of the spring 36 in the midway (as shown in FIG. 5), making the sanitary paper 40 start to suffer the resistance of the spring 36. However, the resistance of the spring 36 is less than the tearing force for the sanitary paper 40, the spring 36 is forced by the stopper pate 354 and twisted, that is, the core 35 is still rotated. When the spring 36 is twisted to a certain extent in which the reaction force of the spring 36 is greater than the tearing force for the sanitary paper 40, the sanitary paper 40 suffers two reversely directed forces and thereby is torn apart along the tearing line by a preset length (as shown in FIG. 6). At the same time, the core 35 is suddenly released from the pulling force and the spring 36 will via the stopper plate 354 push the core 35 to reversely rotate (as shown in FIG. 7). After the free end 362 of the spring 36 is restored to its home position, the core 35 is inertially continuously rotated back until the stopper plate 354 touches the stopper section 321 of the cantilever 32 (as shown in FIG. 8). In the operation of FIG. 7, the core 35 provides a throwing force for the pulling end 41A of the sanitary paper 40, while in the operation of FIG. 8, the sudden stopping of the core 35 will make the pulling end 41A thrown from the upper rear side to the front side to be suspended and located in a ready state for next use. Accordingly, the pulling end 41A will have a fixed length.

In the above operation, the opposite side of the protective cover 34 to the sanitary paper 40 is formed with a protective rib 343 which presses against the sanitary paper 40, whereby when pulled, the sanitary paper 40 is subject to a resistant force less than the pulling force.

According to the above structure, each time the amount of the sanitary pacer torn apart by the user is constant. The user can repeat the tearing operation as necessary. Therefore, no waste due to excessively great force will take place. Moreover, after each tearing operation, the pulling end of the sanitary paper is restored to a fixed length for ready use.

It is to be understood that the above description and drawings are only used for illustrating one embodiment of the present invention, not intended to limit the scope thereof. Any variation and derivation from the above description and drawings should be included in the scope of the present invention.

What is claimed is:

1. A rack for rolling type sanitary paper, comprising a fixing seat fixedly mounted on a wall, a protective cover disposed at top edge of the fixing seat, a cantilever extending from one side of the fixing seat, a shaft one end of which is fixed at a free end of the cantilever and which is disposed in front of the fixing seat, said rack being characterized in that:

the cantilever is disposed with a stopper section in front of the fixed end of the shaft, a core member being fitted around the shaft, an inner end face of the core member being disposed with a stopper plate, whereby when the core member is rotated about the shaft, the stopper plate abuts against the stopper section of the cantilever, a torque spring being fitted around the shaft between the fixed end thereof and the opposite end face of the core member, one end of the torque spring being fixed on the cantilever, while the other end thereof radially extending out along the inner end face of the core member to transversely interrupt the moving path of the stopper plate when the core member is rotated.

2. A rack as claimed in claim 1, wherein an inner face of the protective cover is formed with ribs.

* * * * *